US005522202A

United States Patent [19]

Weder et al.

[11] Patent Number: 5,522,202

[45] **Date of Patent: *Jun. 4, 1996**

[54] METHOD FOR WRAPPING A FLORAL GROUPING WITH WATER HOLDING AND RELEASING MATERIAL

[75] Inventors: Donald E. Weder; Joseph G. Straeter, both of Highland, Ill.

[73] Assignees: The Family Trust U/T/A; Southpac Trust International, Inc., Highland, Ill.

[ * ] Notice: The term of this patent shall not extend beyond the expiration date of Pat. No. 5,335,475.

[21] Appl. No.: 201,825

[22] Filed: Feb. 25, 1994

Related U.S. Application Data

[63] Continuation of Ser. No. 922,293, Jul. 30, 1992, Pat. No. 5,335,475.

[51] Int. Cl.[6] ..... B65B 11/02; B65B 11/48; B65B 25/02; B65B 55/22

[52] U.S. Cl. ..... 53/397; 53/410; 53/431; 53/465; 53/466; 53/462; 53/469; 53/472; 53/474; 47/72; 47/80

[58] Field of Search ..... 53/397, 399, 410, 53/465, 415, 474, 466, 462, 431, 469, 472; 47/79, 80, 81, 72

[56] References Cited

U.S. PATENT DOCUMENTS

| | | | |
|---|---|---|---|
| Re. 21,065 | 5/1939 | Copeman | 93/2 |
| 732,889 | 7/1903 | Paver . | |
| 1,446,563 | 2/1923 | Hughes . | |
| 1,525,015 | 2/1925 | Weeks . | |
| 1,863,216 | 6/1932 | Wordingham . | |
| 2,048,123 | 7/1936 | Howard | 229/87 |
| 2,170,147 | 8/1939 | Lane | 206/56 |
| 2,278,673 | 4/1942 | Savada et al. | 154/43 |
| 2,302,259 | 11/1942 | Rothfuss | 41/10 |
| 2,355,559 | 8/1944 | Renner | 229/8 |
| 2,371,985 | 3/1945 | Freiberg | 206/46 |
| 2,411,328 | 11/1946 | MacNab | 32/12 |
| 2,510,120 | 6/1950 | Leander | 117/122 |
| 2,529,060 | 11/1950 | Trillich | 117/68.5 |
| 2,621,142 | 12/1952 | Wetherell | 154/117 |
| 2,822,287 | 2/1958 | Avery | 117/14 |
| 2,846,060 | 8/1958 | Yount | 206/58 |
| 2,850,842 | 9/1958 | Eubank, Jr. | 47/58 |
| 2,883,262 | 4/1959 | Borin | 21/56 |
| 3,022,605 | 2/1962 | Reynolds | 47/58 |
| 3,121,647 | 2/1964 | Harris et al. | 118/202 |
| 3,130,113 | 4/1964 | Silman | 161/97 |
| 3,271,922 | 9/1966 | Wallerstein et al. | 53/3 |
| 3,508,372 | 4/1970 | Wallerstein et al. | 53/3 |
| 3,620,366 | 11/1971 | Parkinson | 206/59 |

(List continued on next page.)

FOREIGN PATENT DOCUMENTS

| | | |
|---|---|---|
| 0050990 | 5/1982 | European Pat. Off. . |
| 2610604 | 8/1988 | France . |
| 2651663 | 3/1991 | France . |
| 345464 | 2/1917 | Germany . |
| 1131043 | 6/1962 | Germany . |

OTHER PUBLICATIONS

Exhibit A—"The Simple Solution For Those Peak Volume Periods", Highland Supply Speed Cover® Brochure, 1989©, 6 pages.

Exhibit B—"Speed Sheets® And Speed Rolls", Highland Supply Speed Sheets® Brochure, 1900©, 2 pages.

Exhibit C—"A World of Cut Flower and Pot Plant Packaging", Klerk's Plastic Products Manufacturing, Inc. Brochure, date unknown, 6 pages.

Exhibit D—is a fan-folded "Post-It® Note Pad, for pop-up note dispensers," R-330, 1 Pad (100 sheets) 3"×3" (76.2 mm×76.2 mm). Manufactured by 3M Commerical Office Supply Division, St. Paul, MN. 55144-1000.

*Primary Examiner*—Horace M. Culver
*Attorney, Agent, or Firm*—Dunlap & Codding

[57] ABSTRACT

Several embodiments of a method for wrapping a floral grouping, to form a wrapper with a water holding and releasing material disposed in the wrapper in contact with a portion of the floral grouping, are disclosed. Several embodiments of wrappers are also disclosed.

26 Claims, 7 Drawing Sheets

U.S. PATENT DOCUMENTS

| | | | |
|---|---|---|---|
| 3,681,105 | 8/1972 | Milutin et al. | 117/15 |
| 3,793,799 | 2/1974 | Howe et al. | 53/32 |
| 4,054,697 | 10/1977 | Reed et al. | 428/40 |
| 4,118,890 | 10/1978 | Shore | 47/28 |
| 4,216,620 | 8/1980 | Weder et al. | 47/72 |
| 4,280,314 | 7/1981 | Stuck | 53/241 |
| 4,297,811 | 11/1981 | Weder | 47/72 |
| 4,300,312 | 11/1981 | Weder | 47/72 |
| 4,333,267 | 6/1982 | Witte | 47/84 |
| 4,380,564 | 4/1983 | Cancio et al. | 428/167 |
| 4,413,725 | 11/1983 | Bruno et al. | 206/45.33 |
| 4,546,875 | 10/1985 | Zweber | 206/0.82 |
| 4,640,079 | 2/1987 | Stuck | 53/390 |
| 4,765,464 | 8/1988 | Ristvedt | 206/0.82 |
| 4,773,182 | 9/1988 | Weder et al. | 47/72 |
| 4,941,572 | 7/1990 | Harris | 53/431 X |
| 5,099,609 | 3/1992 | Yamauchi | 47/81 |
| 5,111,638 | 5/1992 | Weder | 53/397 |
| 5,335,475 | 8/1994 | Weder et al. | 53/397 |

METHOD FOR WRAPPING A FLORAL GROUPING WITH WATER HOLDING AND RELEASING MATERIAL

This is a continuation of application(s) Ser. No. 07/922,293 filed on Jul. 30, 1992, and now U.S. Pat. No. 5,335,475.

FIELD OF THE INVENTION

The present invention relates generally to wrappers for floral groupings and, more particularly, but not by way of limitation, to a wrapper for a floral grouping having a water holding and releasing material disposed in the wrapper.

DESCRIPTION OF THE PREFERRED EMBODIMENTS

Figure 1:
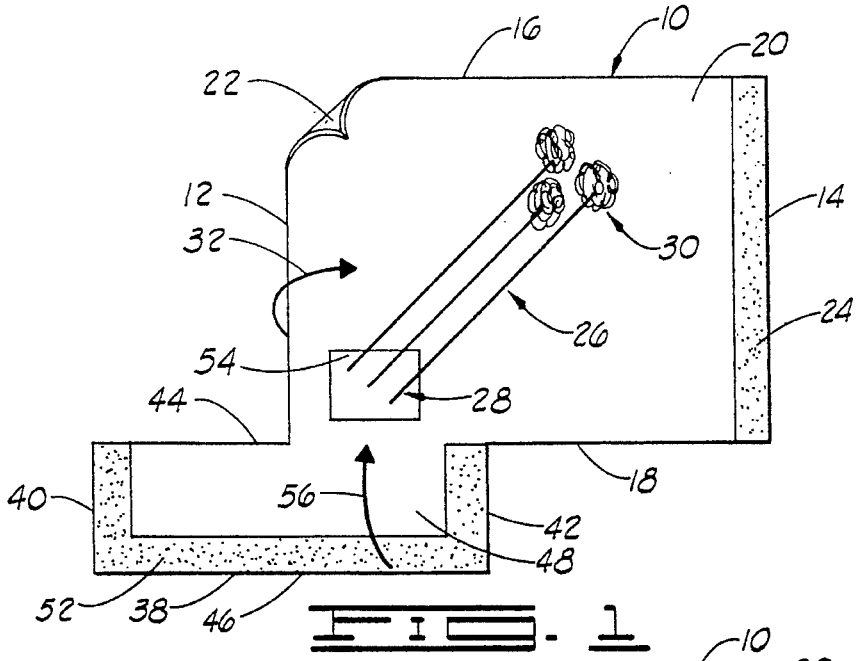
FIG. 1 is a top plan view of the upper surface of a sheet of material constructed in accordance with the present invention showing a floral grouping disposed on a portion of the sheet of material and showing water holding and releasing material associated with the sheet of material, the sheet of material being shown in FIG. 1 prior to the sheet of material being wrapped about the floral grouping.

Shown in FIG. 1 is a sheet of material 10 constructed in accordance with the present invention. The sheet of material 10 includes a first end 12, a second end 14, a first side 16 and a second side 18. The sheet of material 10 also includes an upper surface 20 and a lower surface 22. A closure bonding material 24 is disposed on the upper surface 20 of the sheet of material 10. The closure bonding material 24 is disposed adjacent the first end 12 of the sheet of material 10 and extends generally between the first side 16 and the second side 18 of the sheet of material 10.

The sheet of material 10 is constructed from any suitable flexible material that is capable of being wrapped about the floral grouping 26, as described herein. Preferably, the sheet of material 10 is constructed of a material selected from a group of materials consisting of paper, metal foil, cloth (natural or synthetic), denim, burlap or polymer film or combinations thereof.

The term "polymer" as used herein means any polymer film. For example, but not by way of limitation, one polymer film is a polypropylene film. Another example of a polymer film, but not by way of limitation, is cellophane.

The sheet of material 10 has a thickness in a range from about 0.1 mils to about 30 mils. Preferably, the sheet of material 10 has a thickness in a range from about 0.1 mils to about 5 mils.

The sheet of material 10 may be any shape and a square or rectangle shape is shown in FIG. 1 only by way of example. The sheet of material 10 for example only may be square, rectangular, circular or any other geometric shape.

The sheet of material 10 may be constructed of a single layer of material or a plurality of layers of the same or different types of materials. Any thickness of the sheet of material 10 may be utilized in accordance with the present invention as long as the sheet of material 10 is wrappable about the floral grouping, as described herein. Additionally, an insulating material such as bubble film, preferable as one of two or more layers, can be utilized in order to provide additional protection for the item wrapped therein. The layers of material comprising the sheet of material 10 may be connected together or laminated or may be separate layers.

Figure 4:
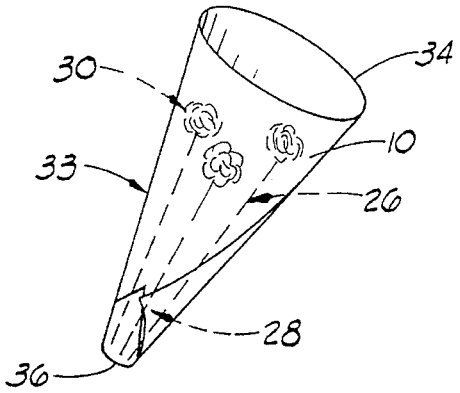
FIG. 4 is a perspective, diagrammatic view showing the sheet of material of FIGS. 1, 2 and 3 wrapped about the floral grouping with the water holding and releasing material disposed in the wrapper.

A floral grouping 26 having a stem end 28 and a bloom end 30 is disposed on the upper surface 20 of the sheet of material 10, as shown in FIG. 1. The first end 12 of the sheet of material 10 is extended or rolled in a direction 32 as indicated in FIG. 1 over the floral grouping 26 and the sheet of material 10 is wrapped or rolled about the floral grouping 26 in one or a series of wraps until the closure bonding material 24 is disposed adjacent a portion of the lower surface 22 of the sheet of material 10 to form a wrapper 33 as shown in FIG. 4. The closure bonding material 24 bondingly engages and bondingly contacts an adjacent portion of the lower surface 22 of the sheet of material 10 to bondingly connect the first end 12 of the sheet of material 10 to another portion of the sheet of material for securing the sheet of material 10 in the form of the wrapper 33 wrapped about the floral grouping 26.

The wrapper 33 has an open upper end 34 and an open lower end 36. At least a portion of the floral grouping 26 is disposed within the wrapper 33. In some applications, the stem end of the floral grouping 26 extends through the open lower end 34 of the wrapper 33. In some applications, the sheet of material 10 is tightly wrapped about the stem end 28 of the floral grouping 26. The bloom end 30 of the floral grouping 26 is disposed near the open upper end 34 of the floral grouping 26 and the bloom end 30 of the floral grouping 26 is visible via the open upper end 34 of the wrapper 33. In some instances, the bloom end 30 of the floral grouping 26 may extend beyond the open upper end 34 of the wrapper 33. In some applications, the upper end 34 of the wrapper 33 may be closed if desired. In some applications, the lower end 36 of the wrapper 33 may be closed if desired.

The wrapper 33, as shown in FIG. 4, is generally conically shaped. The sheet of material 10 may be wrapped about the floral grouping 26 to form a cylindrically shaped wrapper or any other shape wrapper if desired in a particular application.

"Floral grouping" as used herein means cut fresh flowers, artificial flowers, a single flower, other fresh and/or artificial plants or other floral materials and may include other secondary plants and/or ornamentation which add to the aesthetics of the overall floral grouping.

A decorative pattern, such as a color and/or an embossed pattern, and/or other decorative surface ornamentation may be applied to the upper surface 20 and/or the lower surface 22 of the sheet of material 10 or portions thereof including, but not limited to printed design, coatings, colors, flocking or metallic finishes. The sheet of material 10 also may be totally or partially clear or tinted transparent material.

The term "bonding material" as used herein means an adhesive, preferably a pressure sensitive adhesive, or a cohesive. Where the bonding material is a cohesive, a similar cohesive material must be placed on the adjacent surface for bondingly contacting and bondingly engaging with the cohesive material. The term "bonding material" also includes materials which are heat sealable and, in this instance, the adjacent portions of the material must be brought into contact and then heat must be applied to effect the seal. The term "bonding material" as used herein also means a heat sealing lacquer which may be applied to the sheet of material and, in this instance, heat also must be applied to effect the sealing. The term "bonding material" as used herein means any type of material or thing which can be used to effect the bonding or connecting of the two adjacent portions of the material or sheet of material to effect the connection or bonding described herein. The term bonding material also includes labels, bands, ribbons, strings, tape, staples or combinations thereof. Some of the bonding materials would secure the ends of the material while other bonding material may bind the circumference of the wrapper 33.

Figure 2:
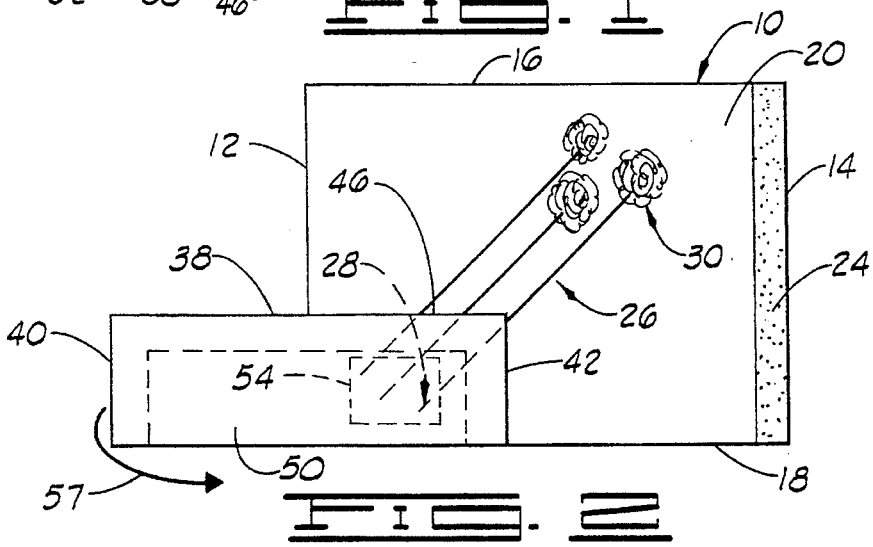
FIG. 2 is a top plan view of the upper surface of a sheet of material of FIG. 1 but showing a portion of the sheet of material partially wrapped about the water holding and releasing material, prior to the sheet of material being wrapped about the floral grouping.
Figure 3:
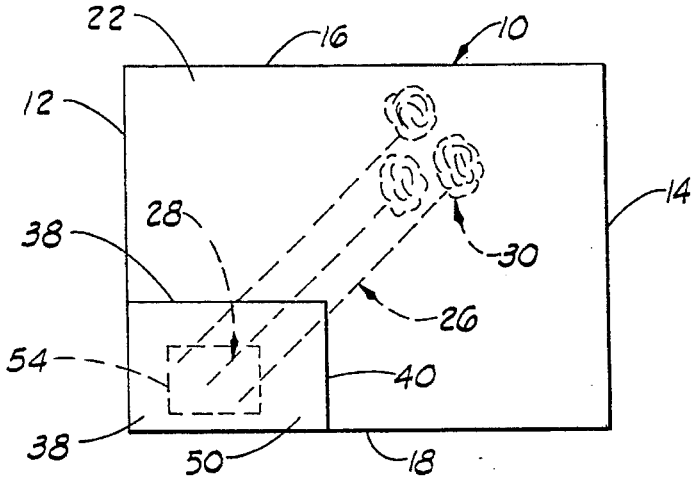
FIG. 3 is a plan view of the sheet of material of FIG. 2, but showing the lower surface of the sheet of material after a portion of the sheet of material has been secured about the water holding and releasing material prior to the sheet of material being wrapped about the floral grouping.

As shown in FIG. 1, the sheet of material 10 includes an extension 38 having a first end 40, a second end 42, a first side 44, a second side 46, an upper surface 48 and a lower surface 50 (FIG. 2 and 3). A portion of the first side 44 of the extension 38 is connected to a portion of the second side 46 of the sheet of material 10 generally near the second end 42 thereof with a portion of the extension 38 extending outwardly beyond the first end 40 of the sheet of material 10 terminating with the first end 40 of the extension 38. A connecting bonding material 52 is disposed on the upper surface 48 of the extension 38 with the connecting bonding material 52 extending along the first end 40, along the second side 46 and along the first end 40 of the extension 38.

Preferably, the extension 38 is formed integrally with the sheet of material 10. In one other embodiment, the extension 38 is a separate sheet of material which is connected to the sheet of material 10 by way of connecting bonding material. The extension 38 is constructed of materials exactly like those described before with respect to the sheet of material 10 and the connecting bonding material 52 is a bonding material of the type described before with respect to the closure bonding material 24.

In any event, the upper surface 48 of the extension 38 forms a portion of the upper surface 48 of the sheet of material 10 and the lower surface 50 of the extension 38 forms a portion of the lower surface 50 of the sheet of material 10.

A water holding and releasing material 54 is disposed on a portion of the upper surface 48 of the sheet of material 10.

The water holding and releasing material 54 is any material capable of holding water or any other fluid and releasing the held water over a period of time. For example only, the water holding and releasing material 54 may be a paper material, a block of florist foam, a natural or synthetic sponge, cotton or synthetic woven material, or a cloth material or a burlap material. The water holding and releasing material 54 may be a single piece of material or a plurality of pieces of material as may be desired in a particular application. For example only, the water holding and releasing material 54 also may be a polyacrylamide type of material such as sold by Allied Colloids under their brand name Alcosorb AB3C. With this material last mentioned being capable of absorbing water and slowly releasing the water over a period of time.

The water holding and releasing material 54 is disposed on a portion of the upper surface 20 of the sheet of material 10 generally near and spaced a distance from the first end 12 and generally near and spaced a distance from the second side 18 of the sheet of material 10, as shown in FIG. 1. The floral grouping 26 is placed on the upper surface 20 of the sheet of material 10 and positioned thereon to extend generally angularly over a portion of the upper surface 20 of the sheet of material 10, although it is not necessary to angularly extend the floral grouping 26 if desired in a particular application. The floral grouping 26 is positioned so that a portion of the stem end 28 of the floral grouping 26 is in contact with the water holding and releasing material 54.

After the water holding and releasing material 54 and the floral grouping 26 have been positioned on the upper surface 20 of the sheet of material 10 in the manner described before, the second side 46 of the extension 38 is moved in a general direction 56 (FIG. 1) to position the extension 38 over a portion of the sheet of material 10 with the upper surface 48 of the extension 38 being disposed adjacent the upper surface 20 of the sheet of material 10 in the position shown in FIG. 2. In this position, the connecting bonding material 52 bondingly engages the adjacent portion of the upper surface 20 of the sheet of material 10 to bondingly connect a portion of the extension 38 to the upper surface 20 of the sheet of material 10. The connecting bonding material 52 is positioned on the extension 38 and the extension 38 is sized so that, when the extension 38 is disposed on the upper surface 20 of the sheet of material 10 in the position shown in FIG. 2, the connecting bonding material 52 cooperates with the extension 38 to substantially surround the water holding and releasing material 54 with a portion of the extension 38 near the first end 40 thereof extending outwardly a distance beyond the first end 12 of the sheet of material 10.

In this position, the first end 40 of the extension 38 is folded over in a direction 57 (FIG. 2) and disposed adjacent the lower surface 22 of the sheet of material 10 in the position shown in FIG. 3. In this position, a portion of the connecting bonding material 52 bondingly engages and bondingly connects the portion of the extension 38 near the first end 40 thereof to the lower surface 22 of the sheet of material 10. In this position where the extension 38 is completely connected to the sheet of material 10, the extension 38 cooperates with a portion of the sheet of material 10 to encompass and surround the water holding and releasing material 54 and a portion of the stem end 28 of the floral grouping 26. A portion of the connecting bonding material 52 also bondingly engages and bondingly connects to a portion of the stem end 28 of the floral grouping 26 for bondingly securing the floral grouping 26 to the sheet of material 10 for preventing movement of the floral grouping 26 in the wrapper 33. In one other embodiment, the connecting bonding material 52 may be positioned on the extension 38 so that the connecting bonding material 52 does not bondingly engage and bondingly connect to a portion of the stem end 28 of the floral grouping 26 if desired in a particular application.

The sheet of material 10 is wrapped about the floral grouping 26 to form the wrapper 33 in the manner described before. When the sheet of material 10 is wrapped about the floral grouping 26, the water holding and releasing material 54 is disposed in the wrapper 33 near the lower end 36 thereof. More particularly, the water holding and releasing material 54 and the floral grouping 26 is disposed inside the wrapper 33. The water holding and releasing material 54 is in contact or communication with at least a portion of the floral grouping and functions to release water to the floral grouping 26 for cooperating to substantially maintain the freshness of the floral grouping 26 during shipment and during the period of time when the wrapper 33 with the floral grouping 26 disposed therein is held on a shelf or in a point of sale display until purchased by a customer.

In some applications, the closure bonding material 24 may be eliminated, in this instance, the sheet of material 10 without the closure bonding material 24 is wrapped about the floral grouping 26 and the water holding and releasing material 54 is incorporated in the wrapper so formed.

EMBODIMENT OF FIG. 5

Figure 5:
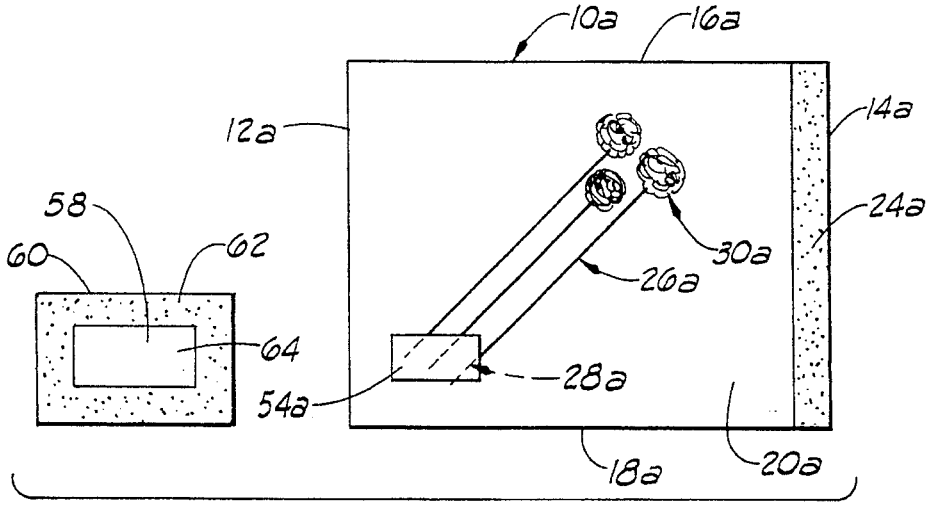
FIG. 5 is a plan view of a modified sheet of material diagrammatically showing a floral grouping disposed on the upper surface of the sheet of material prior to the sheet of material being wrapped about the floral grouping and showing a water holding and releasing material disposed on the upper surface of the sheet of material and showing a plan view of the upper surface of a flap prior to the flap being secured to the sheet of material about the water holding and releasing material.

Shown in FIG. 5 is a modified sheet of material **10*a* which is constructed exactly like the sheet of material 10, except an extension is not formed on or connected to the sheet of material 10*a* like the extension 38. In this embodiment, a separate flap 58 is provided. The flap 58 has an outer peripheral edge 60. A connecting bonding material 62 is disposed on an upper surface 64 of the flap 58 with the connecting bonding material 62 being disposed near and extending about the outer peripheral edge 60 of the flap 58 leaving a central portion of the flap 58** without connecting bonding material disposed thereon.

The flap 58 may be constructed of any of the materials described before with respect to the sheet of material 6210 and the connecting bonding material may be any type of bonding material as described before.

In operation, the floral grouping **26*a* and the water holding and releasing material 54*a* are disposed on the upper surface 20*a* of the sheet of material 10*a* in the manner described before. The flap 58 then is positioned on the upper surface 20*a* of the sheet of material 10*a* in a position wherein the flap 64 substantially encompasses the water holding and releasing material 54*a* with the connecting bonding material 62 extending about the water holding and releasing material 54*a*. In this position of the flap 58, the connecting bonding material 62 bondingly engages a portion of the upper surface 20*a* of the sheet of material 10*a* for bondingly connecting the flap 58 to the sheet of material 10*a***.

After the flap 58 has been secured to the sheet of material **10*a*, the sheet of material 10*a* is wrapped about the floral grouping in the manner described before in connection with the wrapper 33. The only difference is that the flap 58 cooperates to secure the water holding and releasing material 54*a* to the sheet of material 10*a*, rather than the extension 38 on the sheet of material 10 shown in FIGS. 1–4** and described in detail before.

EMBODIMENT OF FIGS. 6 AND 7

Figure 6:
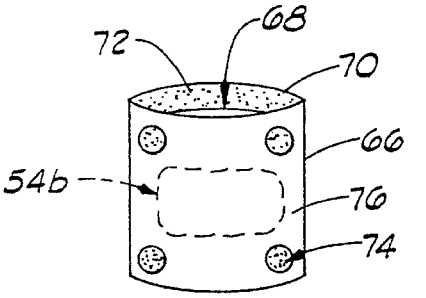
FIG. 6 is a perspective, diagrammatic view of a packet for holding a water holding and releasing material.

Shown in FIG. 6 is a packet 66 which may be constructed of any material such as the materials described before in connection with the sheet of material 10. The packet 66 substantially surrounds and encloses a packet receiving space 68. The packet 66 has an open upper end 70 providing access to the packet receiving space 70.

A connecting bonding material 72 is disposed on a portion of the packet 66 and a connecting bonding material 74 is disposed on a portion of an outer surface 76 of the packet 66. The connecting bonding material 72 is shown in FIG. 6 in the form of a strip of connecting bonding material, although spots or any other geometric shapes or patterns of connecting bonding material may be utilized in a particular application. The connecting material 74 is shown in FIG. 6 in the form of a plurality of spots of connecting bonding material (four spots of connecting bonding material 74 being shown in FIG. 6, for example), although the connecting bonding material 74 could be in the form of strips or any other geometric form and in any pattern. The connecting bonding materials 72 and 74 may be in the form of any of the bonding materials described before.

Figure 7:
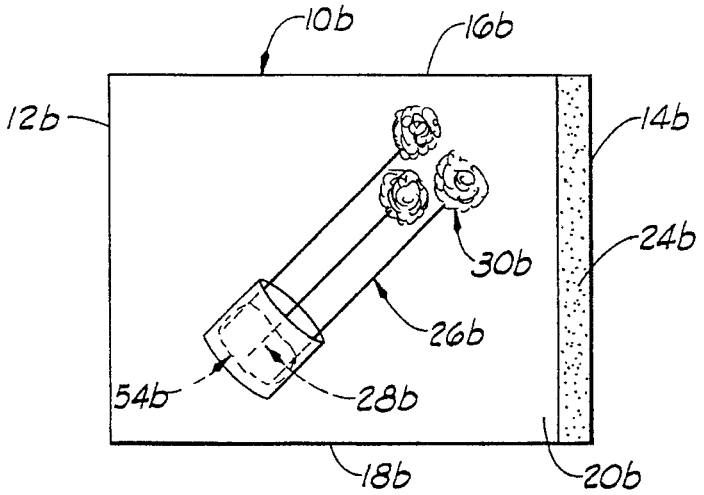
FIG. 7 is a plan view of the upper surface of another modified sheet of material showing the packet of FIG. 6 connected thereto.

Shown in FIG. 7 is a modified sheet of material **10*b* which is constructed exactly like the sheet of material 10*a* shown in FIG. 5**.

The stem end **28*b* of the floral grouping 26*b* then is disposed through the open upper end 70 of the packet 68 and disposed in a portion of the packet receiving space 68 in contact with the water holding and releasing material 54*b***.

In operation, the water holding and releasing material **54*b* is disposed in the packet receiving space 68. The stem end 28*b* of the floral groupng 26*b* is disposed in the packet receiving space 68 in contact with the water holding and releasing material 54*b*. The upper end 70 of the packet 68 then is closed by moving adjacent portions of the upper end 70 of the packet 68 into engagement whereby the connecting bonding material 72 bondingly engages and bondingly connects to adjacent portions of the packet 66 near the upper end 70 thereof thereby closing the upper end 70. The connecting bonding material 72 also may bondingly engage a portion of the stem end 28*b* of the floral grouping 26*b* for bondingly holding the stem end 28*b* in the packet 66**.

The packet 66 with the stem end **28*b* of the floral grouping 26*b* disposed therein then is placed adjacent a portion of the upper surface 20*b* of the sheet of material 10*b* in the position shown in FIG. 7 with the connecting bonding material 74 on the packet 66 bondingly engaging the adjacent portions of the upper surface 20*b* of the sheet of material 10*b* for bondingly connecting the packet 66 to the upper surface 20*b* of the sheet of material 10*b*. The sheet of material 10*b* then is wrapped about the floral grouping 26*b* and the packet 66 in a manner exactly like that described before with respect to the sheet of material 10 to form a wrapper in a manner exactly like that described before in connection with the sheet of material 10 and the wrapper 33**.

EMBODIMENT OF FIGS. 8, 9 AND 10

Figure 8:
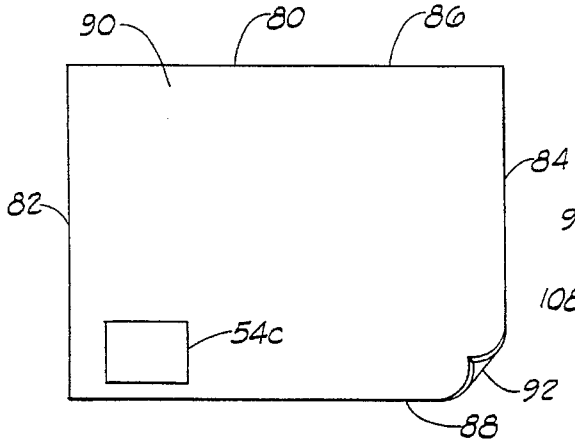
FIG. 8 is a plan view of the upper surface of a first sheet of material showing a water holding and releasing means disposed thereon.

Shown in FIG. 8 is a sheet of material 80 having a first end 82, a second end 84, a first side 86, an upper surface 90 and a lower surface 92. The first sheet of material 80 is constructed of materials exactly like that described before in connection with the sheet of material 10.

As shown in FIG. 8, a water holding a releasing material **54*c* initially is disposed on a portion of the upper surface 90 of the first sheet of material 80 in a position where the water holding and releasing material 54*c* is disposed near and spaced a distance from the second side 86 of the first sheet of material 80 and disposed near and spaced a distance from the first end 82 of the first sheet of material 80**.

Figure 9:
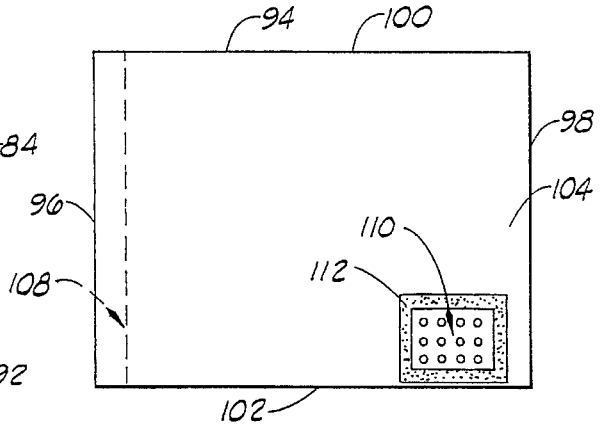
FIG. 9 is a plan view of the lower surface of a second sheet of material.

Shown in FIG. 9 is a second sheet of material 94 having a first end 96, a second end 98, a first side 100, a second side 102, an upper surface 104 and a lower surface 106. The second sheet of material 94 is constructed of any of the materials described before in connection with the sheet of material 10.

A closure bonding material 108 is disposed on the upper surface 104 of the second sheet of material 94. The closure bonding material 108 more particularly is in the form of a strip of closure bonding material disposed near the second end 98 and extending generally between the first and the second sides 100 and 102 of the second sheet of material 94. The closure bonding material 108 may be in the form of any bonding material described before.

A plurality of holes 110 are formed through the second sheet of material 94 with the holes 110 being disposed near and spaced a distance from the first end 86 and disposed near and spaced a distance from the second side 102 of the second sheet of material 94.

A connecting bonding material 112 is disposed on the lower surface 106 of the second sheet of material 94. The connecting bonding material 112 extends generally about the holes 110. The connecting bonding material 112 is shown in FIG. 9 in the form of a strip of connecting bonding material although the connecting bonding material 112 may be in the form of spots or any other geometric shapes or patterns if desired in a particular application. The connecting bonding material 112 may be in the form of any of the bonding materials described before.

In operation, the second sheet of material 94 is disposed on the first sheet of material 80 with the lower surface 106 of the second sheet of material 94 being disposed adjacent the upper surface 90 of the first sheet of material 80. In this position, the first and the second sheets of material 80 and 94 are connected by laminating the first and the second sheets of material 80 and 94 together. The lamination may be effected by disposing connecting bonding material on either the upper surface 90 of the first sheet of material or the lower surface 106 of the second sheet of material 94 or both or by heat sealing or by any of the other forms described before in connection with the bonding material.

Figure 10:
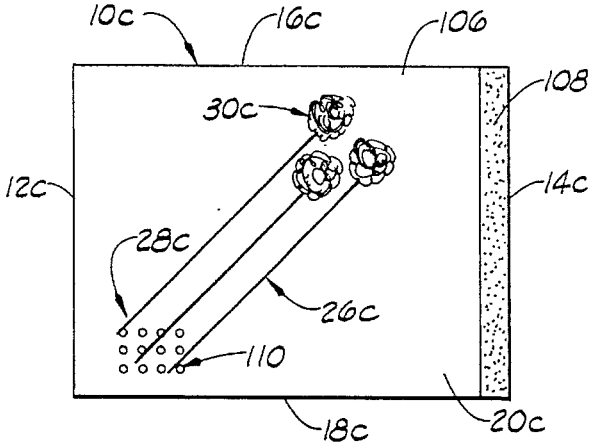
FIG. 10 is a plan view showing the first sheet of material of FIG. 8 connected to the second sheet of material of FIG. 9 to form the sheet of material of the present invention.

The first sheet of material 80 is connected to the second sheet of material 84 to form the modified sheet of material **10*c* shown in FIG. 10 with the upper surface 104 of the second sheet of material 94 forming the upper surface 20c of the sheet of material 10*c* and the lower surface 92 of the first sheet of material 80 forming the lower surface 22*c* of the sheet of material 10*c*. In this connected position of the first and the second sheets of material 80 and 94, the first ends 82 and 96 cooperate to form the first end 12*c* of the sheet of material 10*c*, the second ends 84 and 98 cooperate to form the second end 14*c* of the sheet of material 10*c*, the first sides 86 and 100 cooperate to form the first side 16*c* of the sheet of material 10*c* and the second sides 88 and 102 cooperate to form the second side 18*c* of the sheet of material 10*c*. In this position, the closure bonding material 108 is disposed near the second end 14*c* of the sheet of material 10*c* and extends generally between the first and the second sides 16*c* and 18*c* of the sheet of material 10*c*, as shown in FIG. 10**.

When the first sheet of material 80 is connected to the second sheet of material 94, the connecting bonding material 112 on the second sheet of material 94 bondingly engages and connects to a portion of the first sheet of material 80. The connecting bonding material 112 is positioned on the second sheet of material 94 and sized so that, when the first sheet of material 80 is connected to the second sheet of material 94, the connecting bonding material 112 extends about the water holding and releasing material 54*c* to secure the water holding and releasing material 54*c* to the sheet of material 10*c*. In this position, the holes 110 are disposed generally over the water holding and releasing material 54*c* and extend through the upper surface 20*c* of the sheet of material 10*c*.

The floral grouping 26*c* is position on the upper surface 20*c* of the sheet of material 10*c* with a portion of the stem end 28*c* being disposed over the holes 110. The sheet of material 10*c* then is wrapped about the floral grouping 26*c* to provide a wrapper 33*c* in a manner exactly like that described before in connection with the sheet of material 10 and the wrapper 33 is shown in FIGS. 1–4. Water released by the water holding and releasing material 54*c* exits through the holes 110 and is available to the stem end 28*c* of the floral grouping 26*c* in a manner and for reasons like that described before.

EMBODIMENT OF FIGS. 11, 12 AND 13

Figure 11:
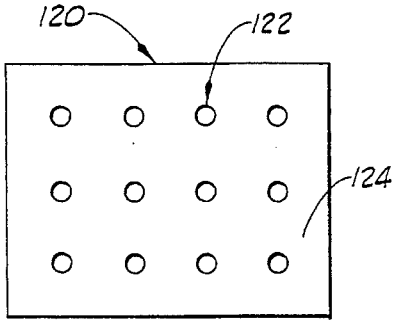
FIG. 11 is a perspective view of a modified packet for holding a water holding and releasing material.

Shown in FIG. 11 is a packet 120 which is constructed exactly like the packet 66 shown in FIG. 6 and described in detail before, except the packet 120 does not include connecting bonding material 74 on the outer surface thereof and the packet 120 includes a plurality of holes 122 formed through a portion of an outer surface 124 thereof. In this embodiment, water holding and releasing material (not shown) is disposed in the packet 120 in a manner exactly like that described before in connection with the packet 66 and the open upper end of the packet 120 then is connectingly closed in a manner like that described before in connection with the packet 66.

Figure 12:
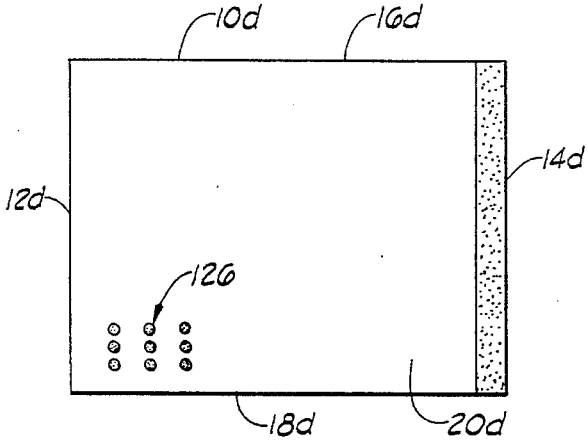
FIG. 12 is a plan view showing the upper surface of yet another modified sheet of material, the packet of FIG. 11 being connectable to the sheet of material shown in FIG. 12.

Shown in FIG. 12 is a sheet of material 10*d* which is constructed exactly like the sheet of material 10*b* shown in FIG. 7 except the sheet of material 10*d* includes a connecting bonding material 126 disclosed on a portion of the upper surface 20*d* of the sheet of material 10*d* with the connecting bonding material 126 being disposed near and spaced a distance from the second side 18*d* and disposed near and spaced a distance from the first end 12*d* of the sheet of material 10*d*. The connecting the bonding material 126 is shown in FIG. 12 in the form of a plurality of spaced apart spots, although the connecting bonding material 126 also may be in the form of strips or a solid continuous mass of connecting bonding material or the spots could be in any shape or geometric pattern if desired.

In operation, the water holding and releasing material is disposed in the packet 120 and the packet 120 is closed. The packet 120 then is positioned adjacent the upper surface 20*d* of the sheet of material 10*d* and positioned on the connecting bonding material 126. The connecting bonding material 126 bondingly engages and bondingly connects the packet 120 to the upper surface 20*d* of the sheet of material 10*d*.

Figure 13:
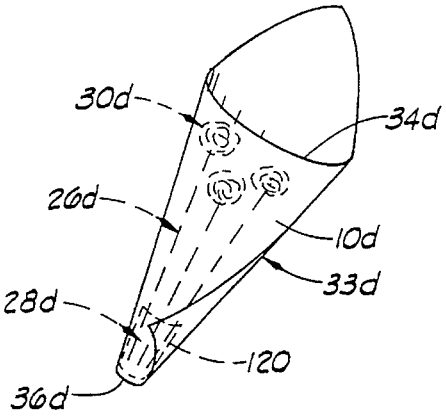
FIG. 13 is a diagrammatic, perspective view of a modified wrapper wrapped about a floral grouping (shown in dashed lines) made by using the packet of FIG. 11 and the sheet of material of FIG. 12.

The stem end 28*d* of the floral grouping 26*d* then is placed over the holes 122 and the packet 120 and the floral grouping 26 are disposed on the upper surface 20*d* of the sheet of material 10*d* in a manner like that described before in connection with the floral grouping and the sheet of material 10 shown in FIGS. 1–4. The sheet of material 10*d* then is wrapped about the floral grouping 26*d* to form the wrapper 33*d* (FIG. 13) in a manner exactly like that described before in connection with the sheet of material 10 and the wrapper 33 shown in FIGS. 1–4. The water holding and releasing material is held on the inside of the wrapper 33*d* by the packet 120 which is bondingly connected to the sheet of material 10*d* by way of the connecting bonding material 126.

The water holding and releasing material may be placed in the wrapper after the sheet of material has been formed about the floral grouping to provide the wrapper if desired in a particular application.

The sheet of material described herein may be provided in the form of a roll of material whereby a portion of the material in the roll of material is unrolled from the roll of material and cuttingly severed therefrom to provide the sheet of material. Also, the sheets of material described herein may be provided in the form of a pad of sheets of material.

EMBODIMENT OF FIG. 14

Figure 14:
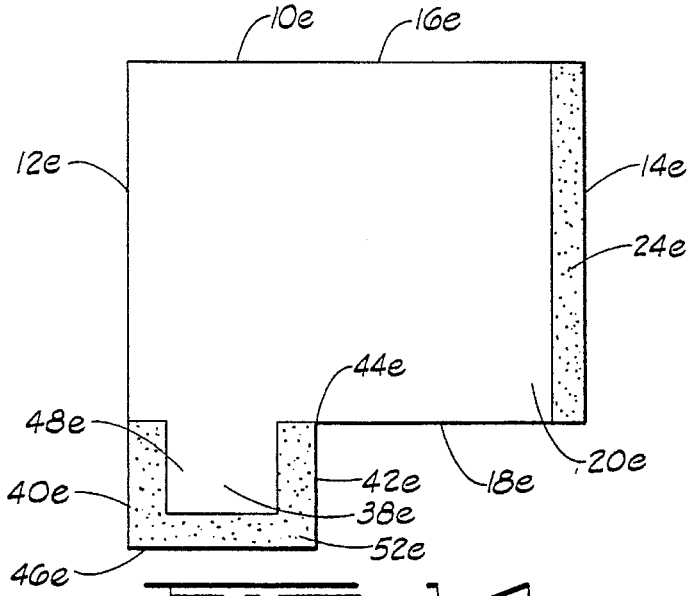
FIG. 14 is a top plan view of the upper surface of a sheet of material similar to the sheet shown in FIG. 1 except the sheet extension extends beyond only one side of the sheet.

Shown in FIG. 14 is a modified sheet of material 10*e* having a modified extension 38*e* formed thereon. The sheet of material 10*e* is constructed exactly like the sheet of material 10 shown in FIG. 1 and described in detail before. The extension 38*e* is formed exactly like the extension 38 shown in FIG. 1 described in detail before, except the first end 40*e* of the extension 38*e* does not extend a distance beyond the first end 12*e* of the sheet of material 10*e*.

The extension 38*e* is disposed over the water holding and releasing material (not shown in FIG. 14) in a manner similar to that described before with respect to the extension 38 shown in FIG. 1, except the extension 38*e* does not have a portion which folds over and connects to the lower surface of the sheet of material 10*e*.

EMBODIMENT OF FIG. 15

Figure 15:
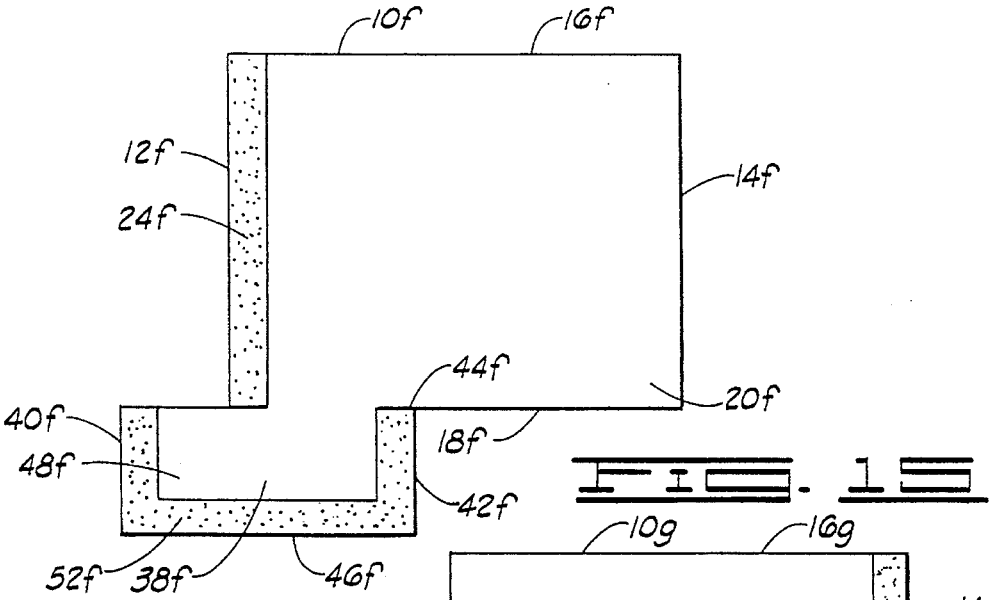
FIG. 15 is a top plan view of the upper surface of a sheet of material exactly the same as the sheet in FIG. 1 except the closure bonding material of the sheet is disposed adjacent the first end of the sheet.

Shown in FIG. 15 is a modified sheet of material 10*f* having a modified extension 38*f* formed thereon. The sheet of material 10*f* is constructed exactly like the sheet of material 10 shown in FIG. 1 and described in detail before, except the closure bonding material 24*f* is disposed adjacent the first end 12*f* and extends generally between the first side 16*f* and the second side 18*f* of the sheet of material 10*f*. The extension 38*f* is constructed exactly like the extension 38 shown in FIG. 1 and described in detail before, except the first end 40*f* of the extension 38*f* does not extend as great a distance beyond the first end 12*f* of the sheet of material 10*f* as compared to the first end 40 of the extension 38 shown in FIG. 1.

In operation, the water holding and releasing material (not shown in FIG. 15) is disposed on the upper surface 20*f* of the sheet of material 10*f* in a position exactly like that described before in connection with the water holding and releasing material 54 shown in FIG. 1. The extension 38*f* then is connected to the upper surface 20*f* and the lower surface of the sheet of material 10*f* in a manner exactly like that described before in connection with the extension 38 shown in FIG. 1 so that the extension 38*f* surrounds and encompasses the water holding and releasing material. In this embodiment, a portion of the closure bonding material 24*f* also bondingly engages a portion of the upper surface 48*f* of the extension 38*f* to cooperate in effecting a water tight seal between the extension 38*f* and the sheet of material 10*f* about the water holding and releasing material.

EMBODIMENT OF FIG. 16

Figure 16:
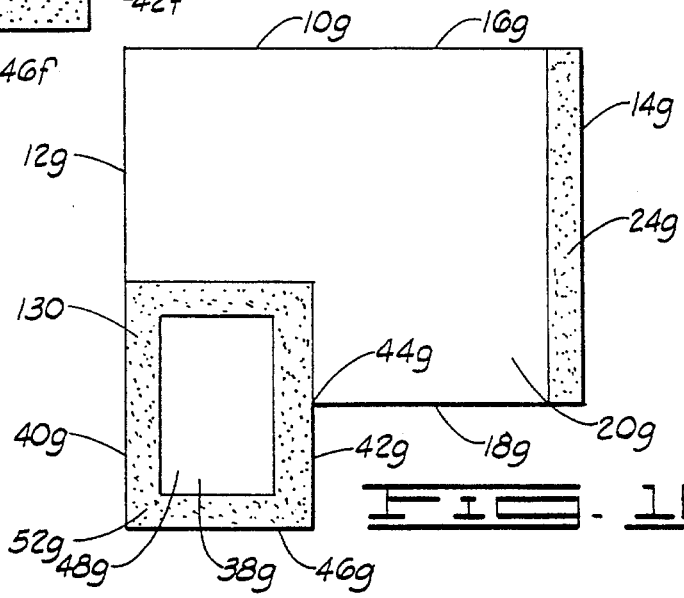
FIG. 16 is a top plan view of the upper surface of a sheet of material similar to FIG. 14 except connecting bonding material extends from the extension onto a portion of the sheet.

Shown in FIG. 16 is a sheet of material 10*g* which is constructed exactly like the sheet of material 10*e* shown in FIG. 14 and described in detail before, except the sheet of material 10*g* has a connecting bonding material 130 disposed on a portion of the upper surface 20*g* thereof. The connecting bonding material 130 extends along a portion of the first end 20*g* and extends around an area in a corner formed by the first end 20*g* and the first side 18*g*. The connecting bonding material 130 is a cohesive.

An extension 38*g* is connected to the sheet of material 10*g*. The extension 38*g* is constructed exactly like the extension 38*e* shown in FIG. 14 and described in detail before, except the connecting bonding material 52*g* more particularly is a cohesive.

In this embodiment, the water releasing and holding material is disposed on the upper surface 20*g* of the sheet of material 10*g* within the space encompassed by the connecting bonding material 130. Then, the extension 38*g* is folded over to a position adjacent the upper surface 20*g* of the sheet of material 10*g* with the cohesive connecting bonding material 52*g* bondingly engaging and bondingly connecting to the cohesive connecting bonding material 130 for securing the extension 38*g* to the upper surface 20*g* of the sheet of material 10*g*.

EMBODIMENT OF FIG. 17

Figure 17:
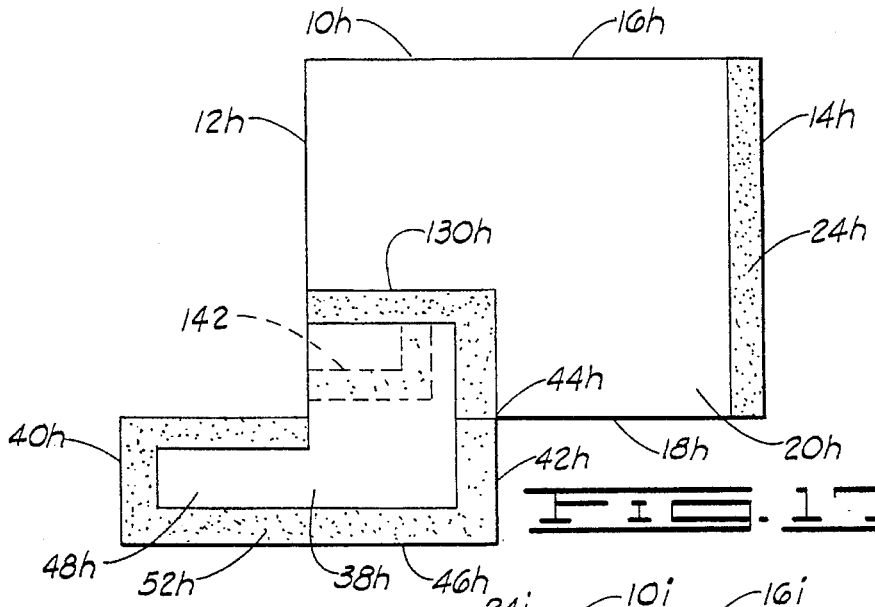
FIG. 17 is a top plan view of a sheet of material combining elements of the sheet of FIGS. 15 and 16 with a cohesive bonding material on the sheet extension and on the sheet for connecting the sheet extension to the sheet.

Shown in FIG. 17 is a sheet of material 10*h* which is constructed exactly like the sheet of material 10*g* shown in FIG. 16, except the sheet of material 10*h* also includes a cohesive strip of material 142 on the lower surface of the sheet of material 10*h* extending from the first end 12*h* a distance toward the second end 14*h* and then a distance toward the first side 16*h*. An extension 38*h* is formed on the sheet of material 10*h*. The extension 38*h* is constructed exactly like the extension 38 shown in FIG. 1, except the extension 38*h* includes a cohesive bonding material 52*h* disposed thereon and the cohesive bonding material 52*h* also includes a portion extending along the first side 44*h* of the extension 38*h*.

The extension 38*h* is folded over and connected to the upper surface 20*h* by way of the adjacent bondingly engaged cohesive portions 130*h* and a portion of the cohesive connecting bonding material 52*h* and then the first end 40*h* of the extension 38*h* is folded over to a position wherein a portion of the cohesive connecting bonding material 52*h* bondingly engages and bondingly connects to the cohesive bonding material 142 on the sheet of material 10*h*.

The extension 38*h* cooperates with the sheet of material 10*h* to connect the water holding and releasing material to the sheet of material 10*h* in a manner like that described before in connection with FIG. 1.

EMBODIMENT OF FIG. 18

Figure 18:
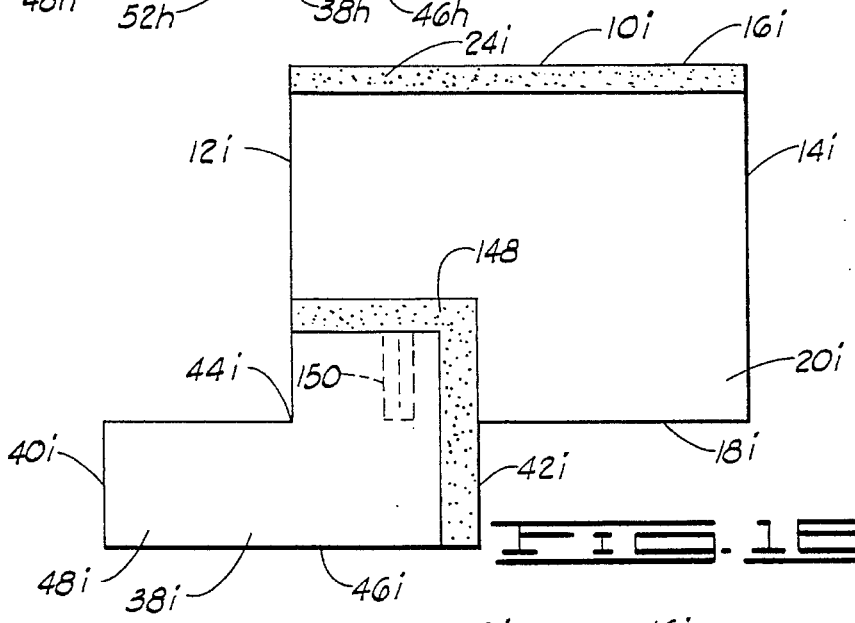
FIG. 18 is a top plan view of the upper surface of a sheet of material similar to the sheet of FIG. 15 except the connecting bonding material disposed thereon is disposed in an alternate pattern and a connecting bonding material is also disposed on the lower surface of the sheet.

Shown in FIG. 18 is a modified sheet of material 10*i* which is constructed exactly like the sheet of material 10 shown in FIG. 1 and described in detail before, except the sheet of material 10*i* has the closure bonding material 24*i* disposed adjacent the first side 16 and extending between the first end 12*i* and the second end 14*i* of the sheet of material 10*i* and the sheet of material 10*i* includes a connecting bonding material 148 which is disposed on the upper surface 20*i* and extends about a portion of the corner of the sheet of material 10*i* near the connection of the first end 12*i* to the second side 18*i* in a pattern like that described before with respect to the connecting bonding material 130*h* shown in FIG. 17 except the connecting bonding material 148 is a pressure sensitive adhesive and the sheet of material 10*i* also includes a strip of adhesive connecting bonding material 150 on the lower surface thereof. The sheet of material 10*i* also includes an extension 38*i* which is constructed exactly like the extension 38 shown in FIG. 1 and described in detail before, except the extension 38*i* does not include any connecting bonding material like the connecting bonding material 52 on the extension 38 shown in FIG. 1.

In this embodiment, the water releasing and holding material (not shown in FIG. 18) is disposed on the upper surface 20*i* of the sheet of material 10*i* generally within the space encompassed by the connecting bonding material 148. The extension 138 then is folded over and connected to the upper surface 20*i* of the sheet of material 10*i* by way of the connecting bonding material 148. The end 40*i* of the extension 38*i* then is folded over and connected to the lower surface of the sheet of material 10*i* by way of the connecting bonding material 150. The sheet of material 10*i* is used to wrap a floral grouping in a manner like that described before in connection with the sheet of material 10 shown in FIG. 1.

EMBODIMENT OF FIG. 19

Figure 19:
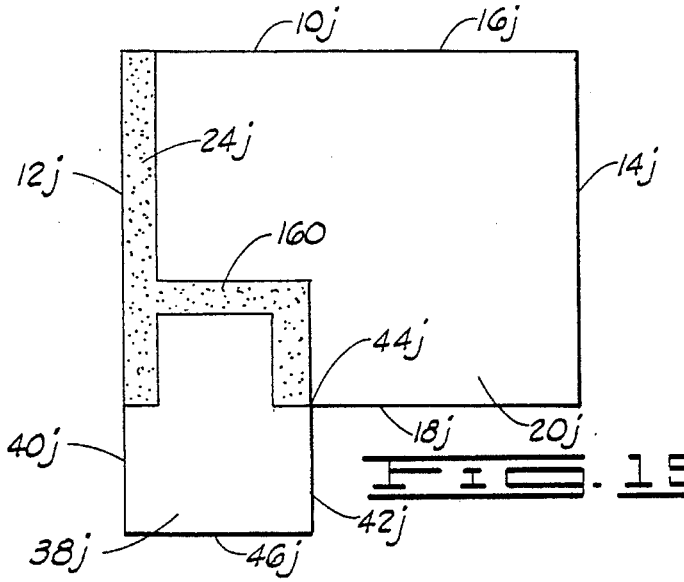
FIG. 19 is a top plan view of the upper surface of a sheet of material similar to the sheet shown in FIG. 14 except the sheet extension has no connecting bonding material disposed thereon.

Shown in FIG. 19 is a modified sheet of material 10*j* which is constructed exactly like the sheet of material 10*f* shown in FIG. 15, except the sheet of material 10*j* also includes a connecting bonding material 160 disposed on the upper surface 20*j* thereof in a pattern similar to that shown in FIG. 18 with respect to the connecting bonding material 150. A sheet extension 38*j* is formed on the sheet of material 10*j*. The extension 38*j* is exactly like the extension 38*e* shown in FIG. 14 and described in detail before, except the extension 38*j* does not include any connecting bonding material on the upper or lower surfaces thereof.

In operation, the water holding and releasing material is disposed on the upper surface 20*j* within the space encompassed by the connecting bonding material 160. The extension 38*j* then is folded over and connected to the upper surface 20*j* of the sheet of material 10*j* by way of the connecting bonding material 160 in a portion of the closure bonding material 24*j*.

EMBODIMENT OF FIG. 20

Figure 20:
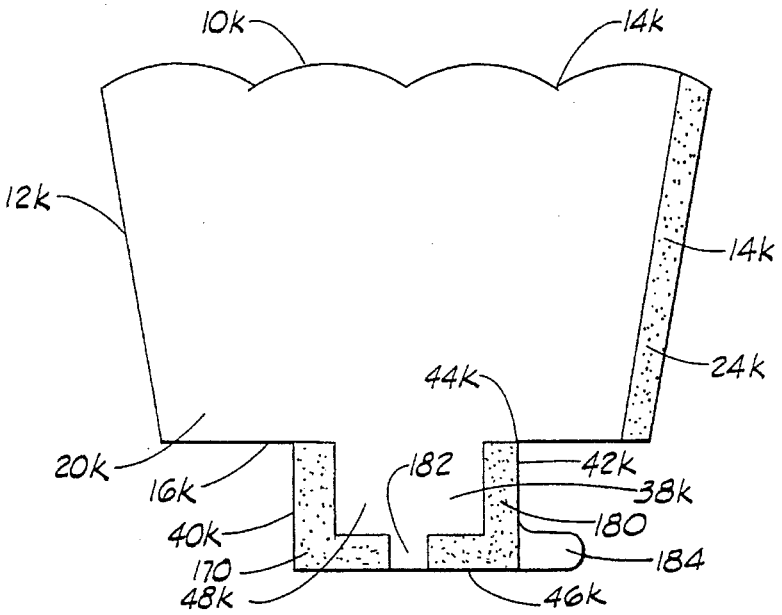
FIG. 20 is a top plan view of the upper surface of a sheet of material having a sheet extension disposed about the center of one side of the sheet and having a narrow gap in the connecting bonding material disposed thereon.

Shown in FIG. 20 is a modified sheet of material 10*k* which is constructed exactly like the sheet of material 10*e* shown in FIG. 14 and described in detail before, except the sheet of material 10*k* is not rectangularly shaped. An extension 38*k* is formed on the second side 16*k* of the sheet of material 10*k* with the extension 38*k* being positioned between the first end 12*k* and the second end 14*k* of the sheet of material 10*k*. The extension 38*k* is exactly like the extension 38*e* shown in FIG. 14 and described before, except the extension 38*k* is formed midway between the first end 12*k* and the second end 14*k* of the sheet 10*k* and the extension 38*k* includes a connecting bonding material 170 which extends along the first end 40*k* and a distance along the second side 46*k*, and the extension 38*k* includes another bonding material 180 extending along the second end 42*k* and extending a distance along the second side 46*k*. The connecting bonding material 170 is spaced a distance 182 from the connecting bonding material 180.

A release tab 184 is formed on the second end 42*k* of the extension 38*k*. In operation, the water holding and releasing material is disposed on the upper surface 20*k* of the sheet of material 10*k* and the extension 38 is folded over and disposed adjacent the upper surface 20*k* with the connecting bonding materials 170 and 180 bondingly engaging and bondingly connecting the extension 38*k* to the upper surface 20*k* of the sheet of material 10*k*. The space 182 between the connecting bonding materials 170 and 180 provides a space for the stem end of the floral grouping to extend through so that the connecting bonding materials 170 and 180 do not bondingly or bondingly connect to the stem end of the floral grouping. When the sheet of material is unwrapped from the floral grouping, the release tab 184 is gripped to pull the extension 38*k* from the upper surface 20*k* of the sheet of material 14*k* to provide easy release for the floral grouping previously wrapped with the sheet of material 10*k*.

EMBODIMENT OF FIG. 21

Figure 21:
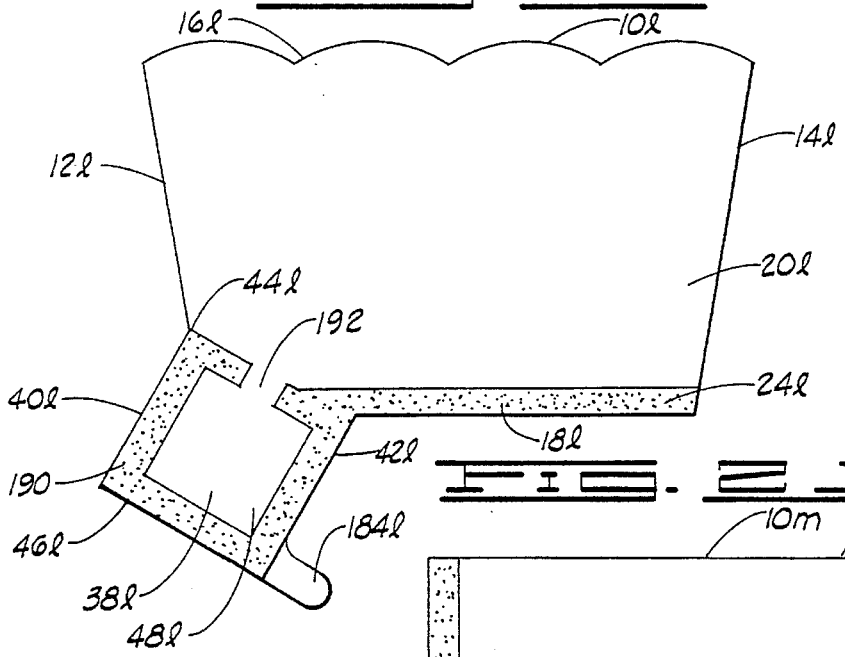
FIG. 21 is a top plan view of the upper surface of a sheet of material having a sheet extension disposed near one corner of the sheet of material and having a narrow gap in the connecting bonding material disposed thereon.

Shown in FIG. 21 is a modified sheet of material 101 which is constructed exactly like the sheet of material 10*k* shown in FIG. 20 and described in detail before, except the closure bonding material 241 is disposed adjacent the second side 181 and extends generally between the first end 121 and the second end 141 of the sheet of material 101. An extension 381 is connected to the sheet of material 101. The extension 381 is constructed exactly like the extension 38*k* shown in FIG. 20 and described in detail before, except the extension 381 is disposed adjacent the first end 121 and extends a distance angularly from the first end 121 and the second side 181 of the sheet of material 101 and the extension 381 includes a connecting bonding material 190 which extends about the peripheral surface of the extension 381 and a space 192 is formed between adjacent portions of the connecting bonding material 190. The space 192 accommodates a portion of the stem end of the floral grouping.

EMBODIMENT OF FIG. 22

Figure 22:
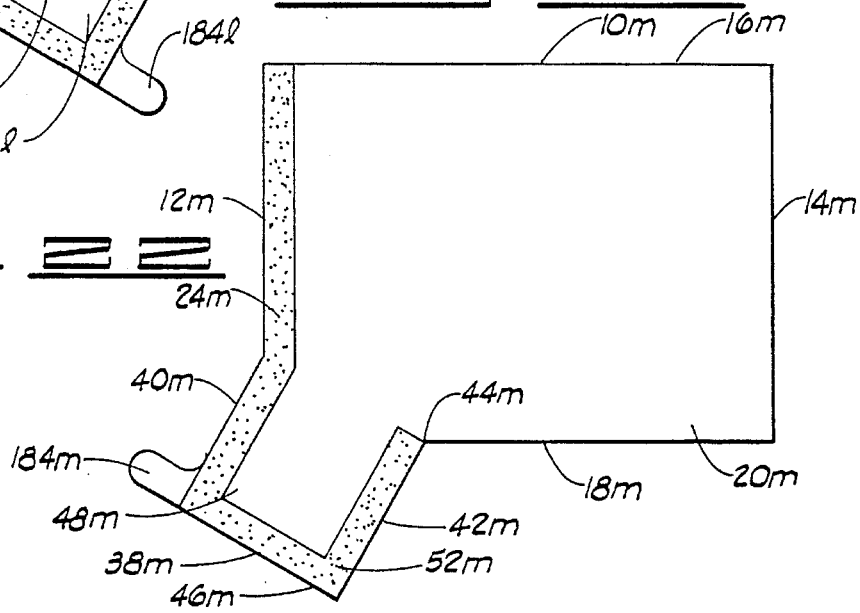
FIG. 22 is a top plan view of a sheet of material similar to the sheet of FIG. 21 except the gap in the connecting bonding material is wider.

Shown in FIG. 22 is a modified sheet of material 10*m* which is constructed exactly like the sheet of material 10*f* shown in FIG. 15 and described in detail before. An extension 38*m* is formed on the sheet of material 10*m*. The extension 38*m* is exactly like the extension 38*e* shown in FIG. 14 and described in detail before, except the extension 38*m* extends angularly from the first end 12*m* and angularly from the second side 18*m* of the sheet of material 10*m* and a release tab 184*m* is formed on the first end 40*m* of the extension 38*m*.

In operation, the water holding and releasing material is placed on the upper surface 20*m* of the sheet of material 10*m* and the extension 38*m* is folded over and disposed adjacent the upper surface 20*m* with the connecting bonding material 52*m* bondingly engaging in bondingly connecting the extension 38*m* to the upper surface 20*m* of the sheet of material 10*m*.

EMBODIMENT OF FIG. 23

Figure 23:
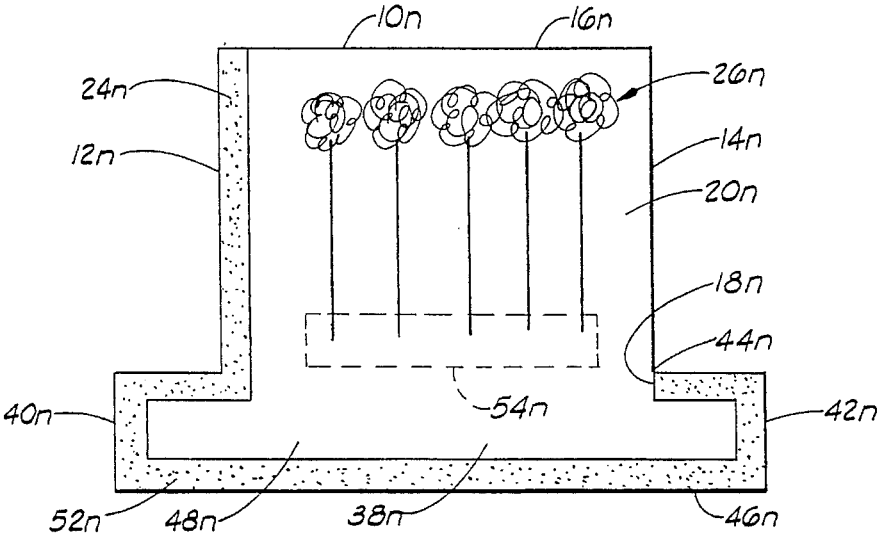
FIG. 23 is a top plan view of the upper surface of a sheet of material having a sheet extension which extends beyond two opposite sides of the sheet.

Shown in FIG. 23 is a modified sheet of material 10*n* which is constructed exactly like the sheet of material 10 shown in FIG. 1 and described in detail before, except the closure bonding material 24 is disposed adjacent the first end 12*n* and extends between the first side 16*n* and the second side 18*n* of the sheet of material 10*n*. An extension 38*n* is formed on the second side 18*n* of the sheet of material 10*n*. The extension 38*n* is exactly like the extension 38 shown in FIG. 1 and described in detail before, except the second end 42*n* of the extension 38*n* extends a distance beyond the second end 14*n* of the sheet of material 10*n*.

The water holding and releasing material 54*n* is placed on the upper surface 20*n* of the sheet of material 10*n* and the floral grouping 26*n* is placed on the upper surface 20*n* of the sheet of material 10*n*. The extension 38*n* then is folded over and disposed adjacent the upper surface 20*n* with a portion of the connecting bonding material 52*n* bondingly engaging and connecting the extension 38*n* to the upper surface 20*n* of the sheet of material 10*n*. The first end 40*n* of the extension 38*n* is then folded over and bondingly connected to a portion of the lower surface of the sheet of material 10*n* by way of a portion of the bonding material 52*n*. The second end 42*n* then is folded over and connected to a portion of the lower surface of the sheet of material 10*n* by way of a portion of the bonding material 52*n*. In this embodiment, the sheet of material 10*n* preferably is wrapped about the floral grouping 26*n* to form a cylindrically shaped wrapper.

EMBODIMENT OF FIGS. 24 AND 25

Figure 24:
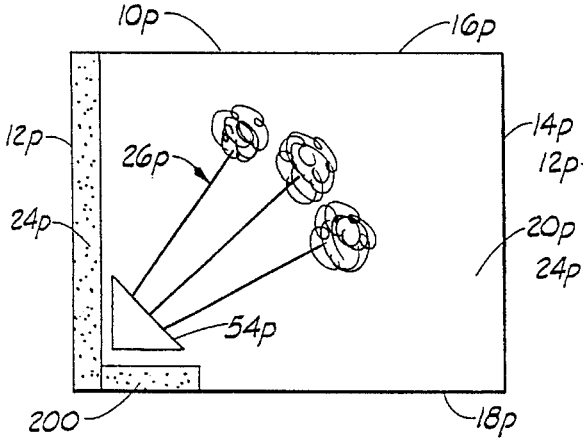
FIG. 24 is a top plan view of the upper surface of a sheet of material having a water holding and releasing material disposed thereupon near one corner of the sheet of material.
Figure 25:
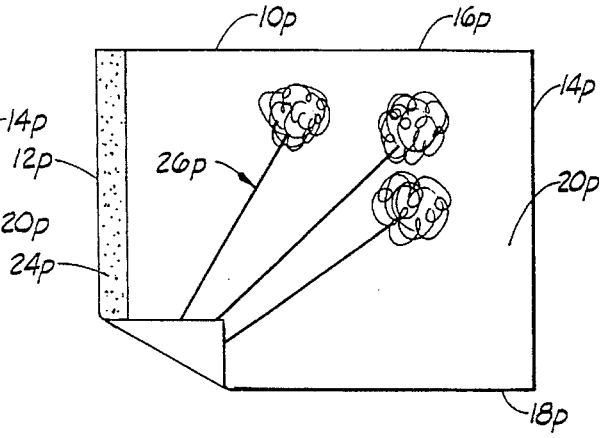
FIG. 25 is a top plan view of the sheet of material shown in FIG. 24 with a portion of the sheet of material folded over and connected to the sheet of material for encompassing and holding the water holding and releasing material.

Shown in FIGS. 24 and 25 is a modified sheet of material 10*p* which is constructed exactly like the sheet of material 10 shown in FIG. 1 and described in detail before, except the closure bonding material 24*p* is disposed adjacent the first end 12*p* and extends generally between the first side 16*p* and the second side 18*p* of the sheet of material 10*p* and the sheet of material 10*p* includes a connecting bonding material 200 disposed adjacent the second side 18*p* and extending a distance from the first end 20*p* of the sheet of material 10*p*.

In this embodiment, the floral grouping 26*p* is placed on the upper surface 20*p* of the sheet of material 10*p* along with the moisture holding and releasing material 54*p*. A corner of the sheet of material 10*p* then is folded over the water holding and releasing material 54*p* to a position wherein the connecting bonding material 200 and a portion of the closure bonding material 24*p* bondingly engages and bondingly connects to the upper surface 20*p* of the sheet of material 10*p* as shown in FIG. 25 to encompass and enclose the water releasing and holding material 54*p*. The sheet of material 10*p* then is wrapped about the floral grouping 26*p* in the manner described before.

EMBODIMENT OF FIG. 26

Figure 26:
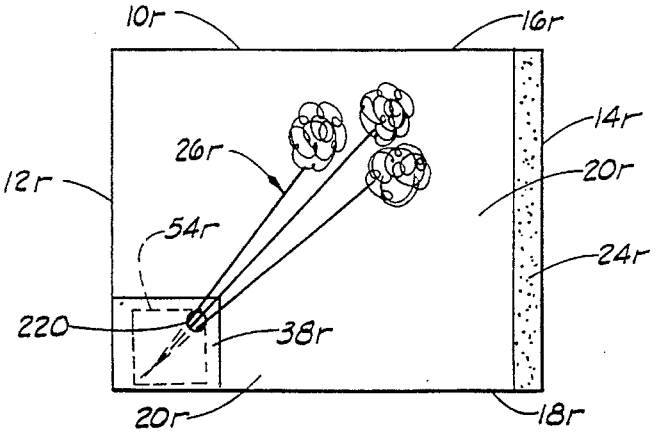
FIG. 26 is a top plan view of another modified sheet of material constructed in accordance with the present invention.

Shown in FIG. 26 is a modified sheet of material 10*r* which is constructed exactly like the sheet of material 10*e* shown in FIG. 14 and described in detail before. An extension 38*r* is formed on the sheet of material 10*r* and the extension 38*r* is constructed exactly like the extension 38*e* shown in FIG. 14 and described in detail before, except a perforated opening 220 is formed in the extension 38*r*. The perforated portion 220 is removed and the extension 38*r* is bondingly connected to the upper surface 20*r* of the sheet of material 10*r* in a manner like that described before in connection with FIG. 14 with the water holding and releasing material 54*r* being disposed under and surrounded by the extension 38*r*. In this embodiment, the stem end of the floral grouping 26*r* extends through the opening 220 formed by removing the perforated portion on the extension 38*r*.

In the embodiments shown in FIGS. 14 through 26, the sheets of material are wrapped about the floral grouping to form a wrapper in a manner as generally described herein.

It should be noted that the connecting bonding material disclosed herein also could be formed by sonic welding if desired in a particular application.

Changes may be made in the construction and the operation of the various components, elements and assemblies described herein and changes may be made in the steps or the sequence of steps of the methods described herein without departing from the spirit and scope of the invention as defined in the following claims.

What is claimed is:

1. A method for wrapping a floral grouping;

providing a sheet of material having a closure bonding material thereon;

providing the floral grouping having a bloom end and a stem end;

placing the floral grouping on the sheet of material;

wrapping the sheet of material about the floral grouping with the sheet of material covering at least a portion of the floral grouping to provide a wrapper, the closure bonding material bondingly engaging a portion of the sheet of material to bondingly hold the sheet of material in the form of a wrapper wrapped about at least a portion of the floral grouping;

providing a water holding and releasing means;

disposing the water holding and releasing means in the wrapper in communication with at least a portion of the floral grouping, the water holding and releasing means being capable of holding water and releasing water to the floral grouping over a period of time.

2. The method of claim 1 wherein the sheet of material is constructed of a material selected from a group of materials consisting of paper, metal foil, cloth (natural or synthetic), denim, burlap or polymer film or combinations thereof.

3. The method of claim 1 wherein the step of providing the sheet of material is defined further as providing the sheet of material having a thickness in a range from about 0.1 mils to about 30 mils.

4. The method of claim 1 wherein the step of providing the sheet of material is defined further as providing the sheet of material having a thickness in a range from about 0.1 mils to about 5 mils.

5. The method of claim 1 wherein the step of wrapping the sheet of material in forming the wrapper is defined further as forming the wrapper with an open upper end and an open lower end.

6. The method of claim 5 wherein the step of wrapping the sheet of material about the floral grouping and forming the wrapper is defined further as forming the wrapper having a conical shape.

7. The method of claim 5 wherein the step of wrapping the sheet of material about the floral grouping and forming the wrapper is defined further as forming the wrapper having a cylindrical shape.

8. The method of claim 5 wherein the step of wrapping the sheet of material about the floral grouping and forming the wrapper is defined further as wrapping the sheet of material about the floral grouping and forming the wrapper with the floral grouping being disposed in the wrapper with the stem end of the floral grouping being disposed near the lower end of the wrapper and the bloom end of the floral grouping being disposed near the upper end of the wrapper.

9. A method for wrapping a floral grouping comprising:

providing a sheet of material having a closure bonding material thereon;

providing the floral grouping having a bloom end and a stem end;

providing a water holding and releasing means capable of holding water and releasing the water over a period of time;

disposing the water holding and releasing material on the sheet of material;

disposing the floral grouping on the sheet of material; and wrapping the sheet of material about the floral grouping with the sheet of material covering at least a portion of the floral grouping to form a wrapper wrapped about at least portion of the floral grouping with the closure bonding material bondingly engaging a portion of the sheet of material to bondingly hold the sheet of material in the form of the wrapper, and with the water holding and releasing means being disposed in the wrapper in communication with at least a portion of the floral grouping.

10. A method for wrapping a floral grouping comprising:

providing a sheet of material having a connecting bonding material and a closure bonding material thereon;

providing the floral grouping having a bloom end and a stem end;

providing a water holding and releasing means capable of holding water and releasing the water over a period of time;

disposing the water holding and releasing material on the sheet of material;

placing the floral grouping on the sheet of material with a portion of the floral grouping being in communication with the water releasing and holding means;

folding a portion of the sheet of material having the connecting bonding material thereon over the water holding and releasing means to a position wherein the connecting bonding material bondingly engages an adjacent portion of the sheet of material to bondingly secure the portion of the sheet of material extending over the water holding and releasing means to connect the water holding and releasing means to the sheet of material; and wrapping the sheet of material with water holding and releasing means thereon about the floral grouping with the sheet of material covering at least a portion of the floral grouping to form a wrapper with the closure bonding material bondingly engaging a portion of the sheet of material to bondingly hold the sheet of material in the form of the wrapper, with the wrapper wrapped about at least a portion of the floral grouping.

11. A method for wrapping a floral grouping comprising:

providing a sheet of material having a closure bonding material thereon;

providing the floral grouping having a bloom end and stem end;

providing a water holding and releasing means capable of receiving and holding water and releasing the water over a period of time;

providing a flap having connecting bonding material disposed thereon;

disposing the water holding and releasing means on the sheet of material;

placing the floral grouping on the sheet of material with a portion of the floral grouping being in contact with the water releasing and holding means;

disposing the flap on the sheet of material extending over the water holding and releasing means and positioning the flap so that the connecting bonding material bondingly engages and bondingly connects the flap to the sheet of material with the flap extending over the water holding and releasing means to secure the flap to the sheet of material;

wrapping the sheet of material about the floral grouping with the sheet of material covering at least a portion of the floral grouping to form a wrapper with the closure bonding material bondingly engaging a portion of the sheet of material to bondingly hold the sheet of material in the form of the wrapper, with the wrapper being wrapped about at least a portion of the floral grouping and the water releasing and holding material being disposed in the wrapper.

12. A method for wrapping a floral grouping comprising:

providing a sheet of material having a closure bonding material thereon;

providing a floral grouping having a stem end and a bloom end;

providing a packet having a packet receiving space;

providing a water holding and releasing means capable of receiving and holding water and releasing the water over a period of time;

disposing the water holding and releasing means in the packet receiving space of the packet;

disposing a portion of the floral grouping in the packet in communication with the water holding and releasing means in the packet;

placing the packet and the floral grouping on the sheet of material; and wrapping the sheet of material with the packet thereon about the floral grouping with the sheet of material covering at least a portion of the floral grouping to form a wrapper with the closure bonding material bondingly engaging a portion of the sheet of material to bondingly hold the sheet of material in the form of the wrapper, with the wrapper being wrapped about at least a portion of the floral grouping.

13. A method for wrapping a floral grouping comprising:

providing a first sheet of material;

providing a second sheet of material;

providing a water holding and releasing means capable of receiving and holding water and releasing the water over a period of time;

disposing the water holding and releasing means on the first sheet of material;

connecting the second sheet of material to the first sheet of means with the water holding and releasing material being disposed between the first and the second sheets of material;

placing the floral grouping on the second sheet of material; and wrapping the first and the second sheets of material about-the floral grouping with the first and the second sheets of material covering at least a portion of the floral grouping to form a wrapper wrapped about at least a portion of the floral grouping and with the water holding and releasing means being disposed in the wrapper.

14. The method of claim 13 wherein the step of providing a first sheet of material further comprises a first sheet of material with a closure bonding material disposed thereon, and wherein the step of wrapping the sheet of material additionally comprises the closure bonding material bondingly engaging a portion of the first or second sheets of material to bondingly hold the sheets of material in the form of the wrapper.

15. The method of claim 13 wherein the step of providing a second sheet of material further comprises a second sheet of material with a closure bonding material disposed thereon, and wherein the step of wrapping the sheet of material additionally comprises the closure bonding material bondingly engaging a portion of the first or second sheets of material to bondingly hold the sheets of material in the form of the wrapper.

16. A method for wrapping a floral grouping comprising:

providing a sheet of material having a closure bonding material thereon;

providing the floral grouping having a bloom end and a stem end;

providing a water holding and releasing means capable of receiving and holding water and releasing the water over a period of time;

providing a packet having a packet receiving space with hole means formed through a portion of the packet;

disposing the water holding and releasing means in the packet receiving space of the packet;

placing the packet on the sheet of material;

placing the floral grouping on the sheet of material with a portion of the floral grouping being disposed over the hole means in the packet whereby the portion of the floral grouping disposed over the hole means in the packet whereby at least a portion of the floral grouping is in communication with the water holding and releasing means by way of the hole means in the packet; and wrapping the sheet of material about the floral grouping with the sheet of material covering at least a portion of the floral grouping to form a wrapper wrapped about at least a portion of the floral grouping with the water holding and releasing means being disposed in the wrapper with the closure bonding material bondingly engaging a portion of the sheet of material to bondingly hold the sheet of material in the form of the wrapper.

17. A method for wrapping a floral grouping comprising:

providing a sheet of material, the sheet of material comprising an extension integral thereto and having a connecting bonding material and a closure bonding material disposed on a portion of the sheet of material;

providing a water holding and releasing means capable of holding water and releasing the water over a period of time;

disposing the water holding and releasing means on the sheet of material;

placing the floral grouping on the sheet of material with a portion of the floral grouping being in communication with the water releasing and holding means;

folding the extension over the water holding and releasing means with the connecting bonding bondingly connecting a surface of the extension to the sheet of material for securing the extension over the water holding and releasing means to connect the water holding and releasing means to the sheet of material, and wrapping the sheet of material with water holding and releasing means thereon about the floral grouping with the sheet of material covering at least a portion of the floral grouping to form a wrapper with the closure bonding material bondingly engaging a portion of the sheet of material to bondingly hold the sheet of material in the form of the wrapper.

18. A method for wrapping a floral grouping comprising:

providing a sheet of material having a closure bonding material thereon;

providing a floral grouping having a stem end and a bloom end;

providing a packet having a packet receiving space, the packet having a connecting bonding material disposed thereon;

providing a water holding and releasing means capable of receiving and holding water and releasing the water over a period of time;

disposing the water holding and releasing means in the packet receiving space of the packet;

placing the packet on a portion of the sheet of material wherein the connecting bonding material on the packet bondingly connects the packet to the sheet of material;

disposing a portion of the floral grouping in the packet in communication with the water holding and releasing means in the packet;

wrapping the sheet of material with the packet thereon about the floral grouping with the sheet of material covering at least a portion of the floral grouping to form a wrapper with the wrapper being wrapped about at least a portion of the floral grouping and with the closure bonding material bondingly engaging a portion of the sheet of material to bondingly hold the sheet of material in the form of the wrapper.

19. A method for wrapping a floral grouping comprising:

providing a sheet of material;

providing a floral grouping having a bloom end and a stem end;

providing a water holding and releasing material capable of holding water and releasing the water over a period of time;

disposing the floral grouping on the sheet of material;

disposing the water holding and releasing material on the sheet of material; and wrapping the sheet of material about the floral grouping with the sheet of material covering at least a portion of the floral grouping to form a wrapper wrapped about at least a portion of the floral grouping and with the water holding and releasing material being disposed in the wrapper in communication with at least a portion of the floral grouping.

20. A method for wrapping a floral grouping comprising:

providing a sheet of material having a connecting bonding material thereon;

providing a floral grouping having a bloom end and a stem end;

providing a water holding and releasing material capable of holding water and releasing the water over a period of time;

placing the floral grouping on the sheet of material;

disposing the water holding and releasing material on the sheet of material with a portion of the floral grouping being in communication with the water releasing and holding material;

folding a portion of the sheet of material having the connecting bonding material thereon over the water holding and releasing material to a position wherein the connecting bonding material bondingly engages an adjacent portion of the sheet of material to bondingly secure the portion of the sheet of material extending over the water holding and releasing material to connect the water holding and releasing material to the sheet of material; and wrapping the sheet of material with water holding and releasing material thereon about the floral grouping with the sheet of material covering at least a portion of the floral grouping to form a wrapper with the wrapper wrapped about at least a portion of the floral grouping.

21. A method for wrapping a floral grouping comprising:

providing a sheet of material with an extension formed on the sheet of material and having a connecting bonding material on the extension;

providing the floral grouping having a bloom end and a stem end;

providing a water holding and releasing material capable of holding water and releasing the water over a period of time;

disposing the water holding and releasing material on the sheet of material;

placing the floral grouping on the sheet of material with a portion of the floral grouping being in communication with the water releasing and holding material;

folding the extension over the water holding and releasing material with the connecting bonding material on the extension bondingly connecting the extension to the sheet of material for securing the extension over the water holding and releasing material to connect the water holding and releasing material to the sheet of material; and wrapping the sheet of material with water holding and releasing material thereon about the floral grouping with the sheet of material covering at least a portion of the floral grouping to form a wrapper with the wrapper wrapped about at least a portion of the floral grouping.

22. A method for wrapping a floral grouping comprising:

providing a sheet of material;

providing a floral grouping having a stem end and a bloom end;

providing a packet having a packet receiving space;

providing a water holding and releasing material capable of receiving and holding water and releasing the water over a period of time;

disposing the water holding and releasing material in the packet receiving space of the packet;

disposing a portion of the floral grouping in the packet in communication with the water holding and releasing material in the packet;

placing the packet and the floral grouping on the sheet of material; and wrapping the sheet of material with the packet thereon about the floral grouping with the sheet of material covering at least a portion of the floral grouping.

23. A method for wrapping a floral grouping comprising:

providing a sheet of material;

providing the floral grouping having a bloom end and a stem end;

providing a water holding and releasing material capable of receiving and holding water and releasing the water over a period of time;

providing a packet having a packet receiving space with hole means formed through a portion of the packet;

disposing the water holding and releasing material in the packet receiving space of the packet;

placing the packet on the sheet of material;

placing the floral grouping on the sheet of material with a portion of the floral grouping being disposed over the hole means in the packet whereby the portion of the floral grouping disposed over the hole means in the packet whereby at least a portion of the floral grouping is in communication with the water holding and releasing material by way of the hole means in the packet; and wrapping the sheet of material about the floral grouping with the sheet of material covering at least a portion of the floral grouping to form a wrapper wrapped about at least a portion of the floral grouping with the water holding and releasing means being disposed in the wrapper.

24. A method for wrapping a floral grouping comprising:

providing a sheet of material, the sheet of material comprising an extension integral thereto and having a connecting bonding material disposed on a portion of the sheet of material;

providing the floral grouping having a bloom end and a stem end;

providing a water holding and releasing material capable of holding water and releasing the water over a period of time;

placing the floral grouping on the sheet of material;

disposing the water holding and releasing material on the sheet of material with a portion of the floral grouping being in communication with the water releasing and holding material;

folding the extension over the water holding and releasing material with the connecting bonding bondingly connecting a surface of the extension to the sheet of material for securing the extension over the water holding and releasing material to connect the water holding and releasing material to the sheet of material; and wrapping the sheet of material with water holding and releasing material thereon about the floral grouping with the sheet of material covering at least a portion of the floral grouping to form a wrapper with the wrapper wrapped about at least a portion of the floral grouping.

25. A method for wrapping a floral grouping comprising:

providing a sheet of material;

providing a floral grouping having a stem end and a bloom end;

providing a packet having a packet receiving space;

providing a water holding and releasing material capable of receiving and holding water and releasing the water over a period of time;

disposing the water holding and releasing material in the packet receiving space of the packet;

placing the packet on the sheet of material;

disposing a portion of the floral grouping in the packet in communication with the water holding and releasing material in the packet; and wrapping the sheet of material with the packet thereon about the floral grouping with the sheet of material covering at least a portion of the floral grouping to form a wrapper with the wrapper being wrapped about at least a portion of the floral grouping.

26. A method for wrapping a floral grouping comprising:

providing a sheet of material having a closure bonding material thereon;

providing the floral grouping having a bloom end and a stem end;

providing a water holding and releasing means capable of holding water and releasing water over a period of time;

disposing the water holding and releasing means on the sheet of material and connecting the water holding and releasing means to the sheet of material; and wrapping the sheet of material with the water holding and releasing means thereon about the floral grouping with the sheet of material covering at least a portion of the floral grouping to form a wrapper wrapped about at least a portion of the floral grouping with the closure bonding material bondingly engaging portion of the sheet of material to bondingly hold the sheet of material in the form of the wrapper and with the water holding and releasing means being disposed in the wrapper in communication with the floral grouping for releasing water to the floral grouping over a period of time.

* * * * *

UNITED STATES PATENT AND TRADEMARK OFFICE

CERTIFICATE OF CORRECTION

PATENT NO. : 5,522,202

DATED : June 4, 1996

INVENTOR(S) : Donald E. Weder et al.

It is certified that error appears in the above-indentified patent and that said Letters Patent is hereby corrected as shown below:

Sheet 6 of 7, at the top of Figure 20, please delete reference numberal "14k", and substitute therefor reference numberal --16k-- as illustrated in Figure 20 below.

Sheet 6 of 7, at the bottom of Figure 20, please delete reference numberal "16k", and substitute therefor reference numberal --18k-- as illustrated in Figure 20 below. (See Attached Sheet)

UNITED STATES PATENT AND TRADEMARK OFFICE

CERTIFICATE OF CORRECTION

PATENT NO. : 5,522,202

DATED : June 4, 1996

INVENTOR(S) : Donald E. Weder et al.

It is certified that error appears in the above-indentified patent and that said Letters Patent is hereby corrected as shown below:

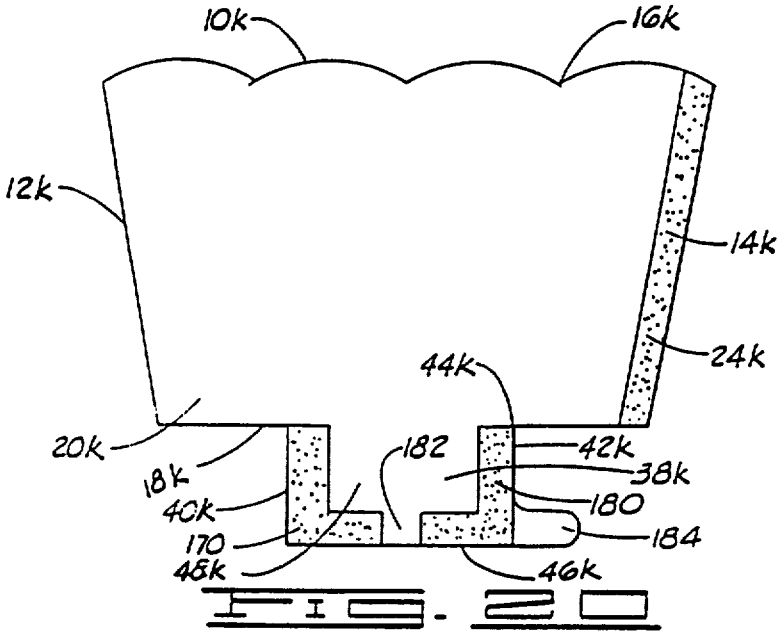

FIG. 2

UNITED STATES PATENT AND TRADEMARK OFFICE

CERTIFICATE OF CORRECTION

PATENT NO. : 5,522,202

DATED : June 4, 1996

INVENTOR(S) : Donald E. Weder et al.

It is certified that error appears in the above-identified patent and that said Letters Patent is hereby corrected as shown below:

Column 6, line 41, please delete "6210", and substitute therefo --10--.

Column 6, line 42, after 'material', please insert --62--.

Column 6, line 49, please delete "64", and substitute therefor --58--.

Column 7, line 4, after 'space', please delete "70", and substitute therefor --68--.

Column 7, line 67, please delete "86", and substitute therefor --88--.

Column 8, line 46, please delete "84", and substitute therefor --94--.

Column 9, line 10, please delete "position", and substitute therefor --positioned--.

Column 11, line 4, please delete "20g", and substitute therefor --12g--.

UNITED STATES PATENT AND TRADEMARK OFFICE

CERTIFICATE OF CORRECTION

PATENT NO. : 5,522,202

DATED : June 4, 1996

INVENTOR(S) : Donald E. Weder et al.

It is certified that error appears in the above-identified patent and that said Letters Patent is hereby corrected as shown below:

Column 11, line 5, please delete "18g", and substitute therefor --16g--.

Column 12, line 11, please delete "138", and substitute therefor --38--.

Column 12, line 47, please delete "16k", and substitute therefor --18k--.

Column 13, line 9, please delete "14k", and substitute therefor --10k--.

Column 14, line 24, after 'end', please delete "20p", and substitute therefor --12p--.

Column 17, line 41, please delete "means", and substitute therefor --material--.

Column 17, line 41, please delete "material", and substitute therefor --means--.

Signed and Sealed this

Twenty-ninth Day of October 1996

Bruce Lehman

*Attest:*

BRUCE LEHMAN

*Attesting Officer*

*Commissioner of Patents and Trademarks*